US007803236B2

(12) United States Patent
Horimura et al.

(10) Patent No.: US 7,803,236 B2
(45) **Date of Patent: *Sep. 28, 2010**

(54) VALVE SPRING RETAINER MADE OF TITANIUM

(75) Inventors: Hiroyuki Horimura, Wako (JP); Kosuke Doi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 517 days.

This patent is subject to a terminal disclaimer.

(21) Appl. No.: 11/095,202

(22) Filed: Mar. 30, 2005

(65) Prior Publication Data

US 2005/0230007 A1 Oct. 20, 2005

(30) Foreign Application Priority Data

Mar. 31, 2004 (JP) ..... 2004-107520

(51) Int. Cl.
*C22C 14/00* (2006.01)

(52) U.S. Cl. ..... 148/421; 148/281

(58) Field of Classification Search ..... 148/281, 148/421

See application file for complete search history.

(56) References Cited

U.S. PATENT DOCUMENTS 5,024,369 A * 6/1991 Froes et al. ..... 228/157
5,051,140 A * 9/1991 Mushiake et al. ..... 148/281
6,371,063 B2 * 4/2002 Oyama et al. ..... 123/90.11

FOREIGN PATENT DOCUMENTS

EP 767245 A1 * 4/1997
JP 1-240639 9/1989

* cited by examiner

*Primary Examiner*—Roy King
*Assistant Examiner*—Jie Yang
(74) *Attorney, Agent, or Firm*—Hamre, Schumann, Mueller & Larson, P.C.

(57) ABSTRACT

To provide a valve spring retainer made of titanium, capable of reduction in raw material cost and processing cost, a valve spring retainer is formed out of a titanium alloy raw material composed of 0.8 wt %≦Fe≦1.2 wt %, 0.24 wt %≦O≦0.32 wt %, 0.02 wt %≦N≦0.05 wt %, and balance Ti containing unavoidable impurities through cold forging.

9 Claims, 5 Drawing Sheets

WIRE ROD CUTTING

SWAGING

PUNCHING

FORGING

VALVE SPRING RETAINER MADE OF TITANIUM

TECHNICAL FIELD

The present invention relates to a titanium valve spring retainer.

BACKGROUND OF THE INVENTION

An internal combustion engine mounted in a mobile machine, such as an automobile, a motorcycle, and so forth, is required to achieve reduction in weight in order to implement higher efficiency in energy consumption. There has been known a valve spring retainer, as a constituent member of a valve mechanism of an internal combustion engine, that is made of titanium which is a lightweight and high-strength material, in an attempt to achieve reduction in the weight of the valve mechanism, leading to reduction in the weight of the internal combustion engine (JP-A No. 240639/1989). In this case, the valve spring retainer is formed by using a β-titanium alloy.

Incidentally, titanium material includes a pure titanium material superior in workability, but low in strength, a titanium alloy, and α-β titanium alloy, both of which are inferior in workability, but high in strength at high temperature, and β-titanium alloy that is suited for cold plastic working, and can attain high strength by applying heat treatment thereto.

In the case of using the pure titanium material, although bolts have been formed by cold forging in a limited application, such an application is limited to JIS class 1 material that is low in strength. The JIS class 1 material is mainly used to obtain corrosion resistance, and with the JIS class 1 material, it is impossible to obtain a specific strength expected of titanium.

For machinery components such as internal combustion engine components, and so forth, the α-β titanium alloy, such as Ti-6Al-4V alloy, and so forth, is in widespread use from a strength point of view. When the α-β titanium alloy is used, however, forming thereof is carried out by hot forging at high temperature, so that a great deal of after-working is required owing to problems of oxidation of the surface thereof, and precision in size. As a result, not only material cost, but also processing cost increases, so that titanium components become very expensive, resulting in difficulty with application thereof to common valve spring retainers for internal combustion engines for vehicles.

Further, the β-titanium alloy can be cold rolled in the process of preparing a raw material, however, when forming components thereof by cold forging, there is a problem with mass production in terms of service life of a mold because of high deformation strength of the raw material, and further, an addition element required for stabilizing a β-phase is expensive, and is high in specific gravity, so that the advantageous effect of reduction in cost cannot be gained.

In view of such circumstances as described, the invention has been developed, and it is an object of the invention to provide a valve spring retainer made of titanium, capable of achieving reduction in material cost and processing cost.

SUMMARY OF THE INVENTION

A valve spring retainer is formed by application of cold forging to a titanium alloy raw material containing 0.8 wt %≦Fe≦1.2 wt %, 0.24 wt %≦O≦0.32 wt %, 0.02 wt %≦N≦0.05 wt %, and balance Ti containing unavoidable impurities.

The invention is further characterized in that oxidation treatment may be applied to the entire surface of the valve spring retainer after the forging.

The invention may have tensile strength not less than 700 MPa, or cross section hardness not less than 230 HV0.1 in Vickers hardness.

Further, the invention can be characterized in that the valve spring retainer may be less than 20 μm in average grain size.

With the invention, use of inexpensive sponge titanium relatively high in impurity content enables the cost of a raw material to be reduced, and by optimally controlling respective addition amounts of impurity elements, such as Fe, O, and N, it is possible to obtain high strength and excellent cold forgeability, so that a manufacturing cost can be reduced by forming the valve spring retainer through the cold forging, and enhancement in yield can be aimed at while obtaining high productivity, thereby ensuring reduction in the manufacturing cost. More specifically, if Fe<0.8 wt %, and O<0.24 wt %, there occurs insufficiency in strength and cold forgeability, if 1.2 wt %<Fe, and 0.32 wt %<O, there occur troubles, such as cracks, and so forth, at the time of the cold forging, and further, if 0.02 wt %≦N≦0.05 wt %, this will be effective for prevention of occurrence of tip cracks and so forth, at the time of the cold forging, so that if composition ranges of Fe, O, and N are set as described in the foregoing, the valve spring retainer can be stably formed through the cold forging.

With the invention, owing to balance between O content of the raw material and surface oxidation, together with the effect of O content set to such a relatively high level as 0.24 wt % ≦O≦0.32 wt %, fatigue strength can be sufficiently secured, and furthermore, by the application of the cold forging prior to the oxidation treatment, it is possible to more efficiently attain enhancement in fatigue strength, and enhance abrasion resistance.

By setting tensile strength to not less than 700 MPa, or cross section hardness to not less than 230 HV0.1 in Vickers hardness, forming of the valve spring retainer through the cold forging can be ensured, thereby aiming at reduction in the weight of the valve spring retainer.

More stable cold forgeability can be obtained while aiming at enhancement in fatigue strength, and the valve spring retainer can be formed through cold forging, thereby enabling the maximum effect of lighter weight to be exhibited.

DETAILED DESCRIPTION OF THE PREFERRED EMBODIMENT

Embodiments of the invention are described hereinafter with reference to one embodiment of the invention, shown in the accompanying drawings.

Figure 1:
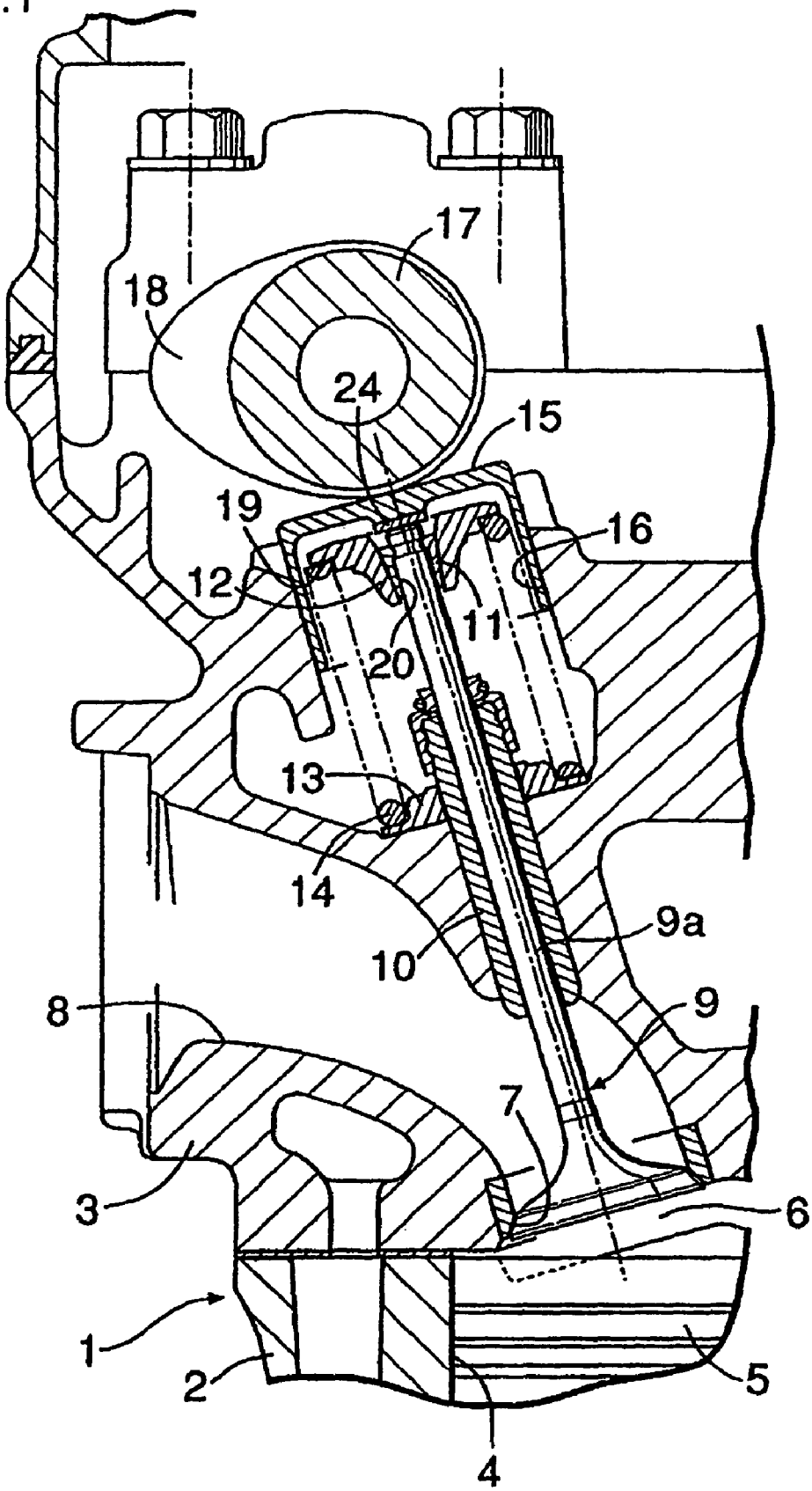
FIG. 1 is a vertical sectional view showing a principal part of an internal combustion engine.

First, in FIG. 1, an engine main unit 1 of, for example, a DOHC internal combustion engine is provided with a cylinder block 2 having a cylinder bore 4, and a cylinder head 3 united with the cylinder block 2, and a combustion chamber 6 faced with the top of a piston 5 slidably fitted into the cylinder bore 4 is formed between the cylinder block 2 and the cylinder head 3.

The cylinder head 3 has an exhaust valve outlet 7 open to the ceiling face of the combustion chamber 6, and an exhaust port 8 communicating with the exhaust valve outlet 7, and a stem 9*a* of an exhaust valve 9 opening/closing the exhaust valve outlet 7 is slidably fitted into a guide cylinder 10.

A valve spring retainer 12 is fixedly attached to an end of the stem 9*a* protruding from the guide cylinder 10 through the intermediary of split cotters 11, and a valve spring 14 in a coil-like shape, surrounding the stem 9*a*, is installed between the valve spring retainer 12, and a spring seat member 13 in such a way as to be compressed, so that the exhaust valve 9 is urged toward a valve-closing direction by repulsive force exhibited by the valve spring 14.

The upper part of the stem 9*a*, the upper part of the valve spring 14, and the valve spring retainer 12 are covered with a valve lifter 15 formed in the shape of a bottomed cylinder, and the upper end of the stem 9*a* is coaxially butted against the center of the inner surface of an upper closed end of the valve lifter 15 through the intermediary of an inner shim 24. Further, the valve lifter 15 is slidably fitted into a guide hole 16 provided in the cylinder head 3.

A valve cam 18 fixed to a cam shaft 17 is in slidable contact with the outer surface of the upper closed end of the valve lifter 15, and in response to rotation of the cam shaft 17, the valve cam 18 pushes down the stem 9*a* against the repulsive force of the valve spring 14, thereby causing the exhaust valve 9 to act for valve opening.

Figure 2:
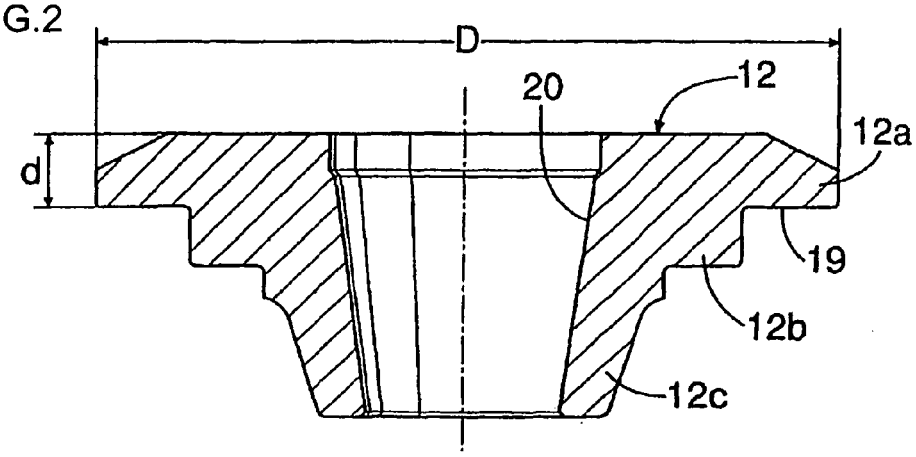
FIG. 2 is an enlarged vertical sectional view of a valve spring retainer.
Figure 3A:
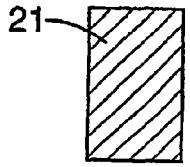
FIG. 3 is a schematic illustration showing a process of forming the valve spring retainer.
Figure 3B:
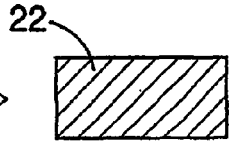
Figure 3C:
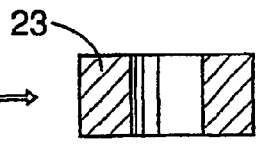
Figure 3D:
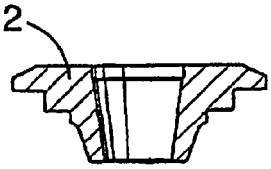

In FIG. 2, the valve spring retainer 12 has a large diameter part 12*a* in the shape of a disc, 21 mm in diameter D, formed to a small thickness d, on the order of, for example, 1.5 mm, in the axial direction, a small diameter part 12*b* formed to a thickness larger than that of the large diameter part 12*a*, in the axial direction, and coaxially joined to a peripheral part of the large diameter part 12*a*, and a tapered part 12*c* formed so as to decrease in diameter, farther away from the small diameter part 12*b*, and coaxially joined to a peripheral part of the small diameter part 12*b*, all the parts being integral with each other, and a seat face 19 annular in shape, for accepting the upper end of the valve spring 14, is formed in a step-like shape between the large diameter part 12*a*, and the small diameter part 12*b*.

Further, the valve spring retainer 12 is provided with a tapered hole 20 for securing the stem, defined so as to penetrate therethrough in the axial direction, and the split cotters 11 are fitted into the tapered hole 20 so as to be sandwiched between the stem 9*a* inserted in the tapered hole 20, and the valve spring retainer 12.

The valve spring retainer 12 as described above is formed by a cold forging process taking steps shown in FIG. 3. In the step of wire rod cutting, shown in FIG. 3(*a*), a wire rod 21 of a given length is cut from a wire blank, in a swaging step, shown in FIG. 3(*b*), a blank 22 in a disc-like shape is obtained by compressing the wire rod 21 in the axial direction, in a punching step shown in FIG. 3(*c*), a ring-like blank 23 can be obtained by punching the center of the blank 22, and the blank 23 is subjected to forging, thereby obtaining the valve spring retainer 12 as shown in FIG. 3(*d*).

Now, since the valve spring retainer 12 is made of titanium, the inventor has continued studies for obtaining the valve spring retainer 12 made of titanium by application of cold forging, contributing to reduction in manufacturing cost, and has consequently found out that excellent cold forgeability can be obtained when use can be made of inexpensive sponge titanium relatively high in impurity content, necessary strength is secured by optimally controlling respective addition amounts of impurity elements, such as Fe, O, and N, and a specific morphology is secured within extremely limited composition ranges.

Figure 4:
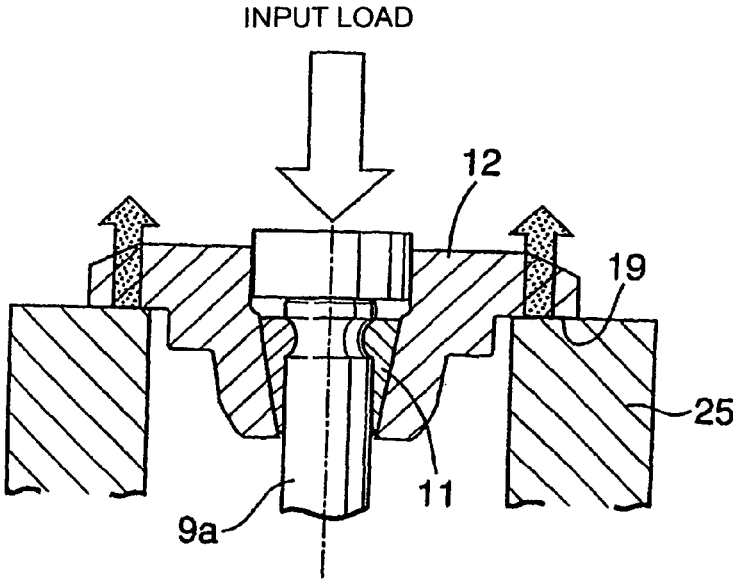
FIG. 4 is a sectional view showing the test state of a fatigue strength test.
Figure 5:
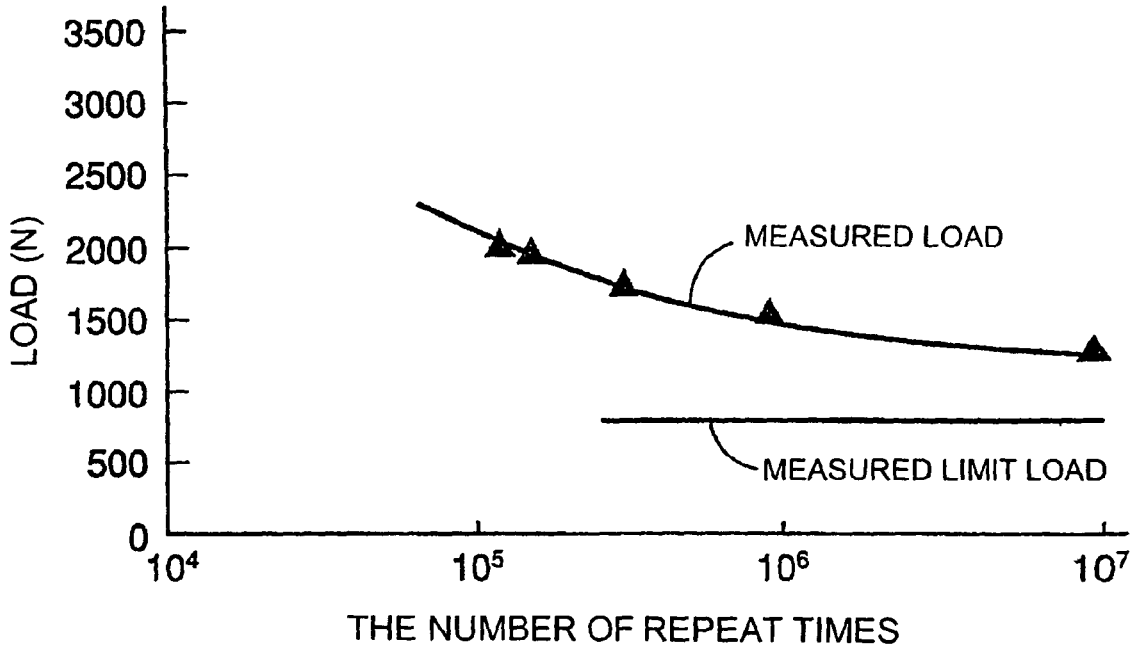
FIG. 5 is a graph showing a relationship between measured load and measured limit load to obtain a fatigue safety factor.

Table 1 shows evaluations made when the valve spring retainer 12 was formed by varying properties of a raw material, and in making evaluation on cold forgeability, symbol O indicates the case where it was possible to excellently form the large diameter part 12*a* of the valve spring retainer 12, 1.5 mm in thickness, without causing cracking, while symbol X indicates the case of failure to do so. Further, when a load from above is repeatedly applied to the stem 9*a* with the valve spring retainer 12 in a state where the seat face 19 thereof is supported by a support 25 as fixed, as shown in FIG. 4, the number of repeat times, resulting in fracture, will vary according to a load as shown in FIG. 5, and assuming that fatigue safety factor is obtained as (measured load/measured limit load), symbol O, in overall evaluation, indicates the case where the cold forgeability is O, and the fatigue safety factor is in excess of 1.2.

TABLE 1

| Testpiece | Properties of a raw material | | | | | | Evaluation | | |
|---|---|---|---|---|---|---|---|---|---|
| | Composition | | | Tensile strength | Hardness | Average grain size | Cold forgeability | Fatigue safety | Overall |
| No. | Fe | O | N | MPa | HV0.1 | μm | *1 | factor > 1.2 | evaluation |
| 1 | 1.03 | 0.200 | 0.027 | 690 | 223 | 16 | ○ | 1.1 | X |
| 2 | 0.59 | 0.209 | 0.031 | 674 | 218 | 18 | X | — | X |
| 3 | 0.71 | 0.236 | 0.029 | 702 | 233 | 17 | X | — | X |
| 4 | 0.81 | 0.250 | 0.024 | 709 | 235 | 15 | ○ | 1.5 | ○ |
| 5 | 0.90 | 0.243 | 0.033 | 720 | 238 | 12 | ○ | 1.5 | ○ |
| 6 | 1.13 | 0.255 | 0.023 | 733 | 243 | 10 | ○ | 1.5 | ○ |
| 7 | 0.86 | 0.280 | 0.027 | 740 | 244 | 13 | ○ | 1.6 | ○ |
| 8 | 0.96 | 0.268 | 0.027 | 733 | 244 | 12 | ○ | 1.5 | ○ |
| 9 | 1.18 | 0.290 | 0.029 | 764 | 254 | 10 | ○ | 1.6 | ○ |

TABLE 1-continued

| Testpiece | Properties of a raw material | | | | | | Evaluation | | |
|---|---|---|---|---|---|---|---|---|---|
| | Composition | | | Tensile strength | Hardness | Average grain size | Cold forgeability | Fatigue safety | Overall |
| No. | Fe | O | N | MPa | HV0.1 | μm | *1 | factor > 1.2 | evaluation |
| 10 | 0.66 | 0.299 | 0.028 | 740 | 245 | 17 | X | — | X |
| 11 | 1.07 | 0.300 | 0.031 | 771 | 253 | 10 | ○ | 1.6 | ○ |
| 12 | 1.13 | 0.308 | 0.022 | 756 | 248 | 9 | ○ | 1.6 | ○ |
| 13 | 0.83 | 0.318 | 0.035 | 779 | 258 | 12 | ○ | 1.6 | ○ |
| 14 | 1.26 | 0.330 | 0.028 | 784 | 258 | 10 | X | — | X |
| 15 | 1.13 | 0.345 | 0.028 | 805 | 268 | 10 | X | — | X |
| 16 | 1.46 | 0.277 | 0.027 | 783 | 260 | 10 | X | — | X |
| 17 | 1.01 | 0.286 | 0.003 | 704 | 231 | 10 | X | — | X |
| 18 | 1.01 | 0.290 | 0.014 | 730 | 243 | 10 | X | — | X |
| 19 | 1.05 | 0.277 | 0.023 | 734 | 243 | 9 | ○ | 1.6 | ○ |
| 20 | 1.04 | 0.282 | 0.035 | 765 | 254 | 10 | ○ | 1.6 | ○ |
| 21 | 1.01 | 0.300 | 0.042 | 791 | 258 | 9 | ○ | 1.7 | ○ |
| 22 | 0.99 | 0.291 | 0.047 | 786 | 261 | 10 | ○ | 1.7 | ○ |
| 23 | 1.00 | 0.291 | 0.053 | 803 | 267 | 10 | X | — | X |
| 24 | 0.98 | 0.269 | 0.061 | 797 | 259 | 10 | X | — | X |
| 25 | 0.98 | 0.273 | 0.073 | 832 | 275 | 9 | X | — | X |
| 26 | 1.05 | 0.277 | 0.023 | — | — | 97 | X | — | X |
| 27 | 1.05 | 0.277 | 0.023 | — | — | 40 | X | — | X |
| 28 | 1.05 | 0.277 | 0.023 | — | — | 25 | X | — | X |
| 29 | 1.05 | 0.277 | 0.023 | — | — | 19 | ○ | 1.5 | ○ |

*1 Thickness of a large diameter part < 1.5 mm

In Table 1, testpieces Nos. 1 and 2 having tensile strength less than 700 MPa, or cross section hardness less than 230 HV0.1 in Vickers hardness are rated X in overall evaluation because a satisfactory fatigue safety factor was not obtainable, and it is evident from this that in order to implement the valve spring retainer 12 having achieved reduction in weight as one made of titanium, tensile strength not less than 700 MPa at the minimum, or cross section hardness not less than 230 HV0.1 in Vickers hardness, at the minimum, are required in the step of the cold forging.

Figure 6:
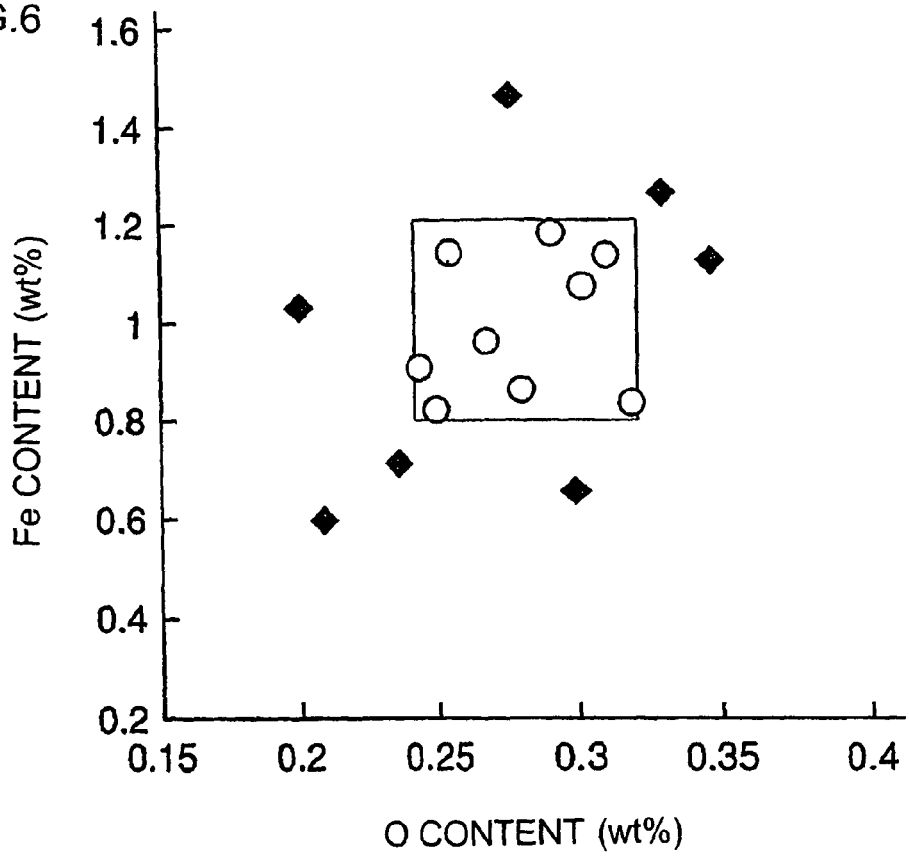
FIG. 6 is a diagram showing a range for determining whether or not cold forgeability is satisfactory, in relation to Fe content and O content.

Furthermore, there is the need for having capability of forming by cold forging in addition to securing the satisfactory fatigue safety factor, so that in an attempt to meet such requirements, determination on whether or not cold forgeability was satisfactory with reference to the testpieces Nos. 1 through 16 was made on the basis of formability of the large diameter part 12*a* of the valve spring retainer 12, and results of the determination are shown in FIG. 6. That is, those within a range surrounded by a square in FIG. 6 exhibited excellent cold forgeability when varying Fe content and O content on conditions that 0.02 wt %≦N≦0.035 wt %, and average grain size is in a range of 9 to 18 μm.

Herein, it is shown that if Fe<0.8 wt %, anisotropy increases, and diagonal cracks occur, resulting in unforgeability, if 1.2 wt %<Fe, cracks occur due to deterioration in ductility, resulting in unforgeability, if O<0.24 wt %, the minimum tensile strength 700 MPa necessary for the valve spring retainer 12 cannot be secured, and if 0.32 wt %<O not only cracks occur but also deformation resistance is too high, thereby resulting in excessive increase in load on a mold for cold forging It is evident from such results that there is the needs for 0.8 wt %≦Fe≦1.2 wt %, and 0.24 wt %≦O≦0.32 wt % in order to obtain excellent cold forgeability.

Figure 7:
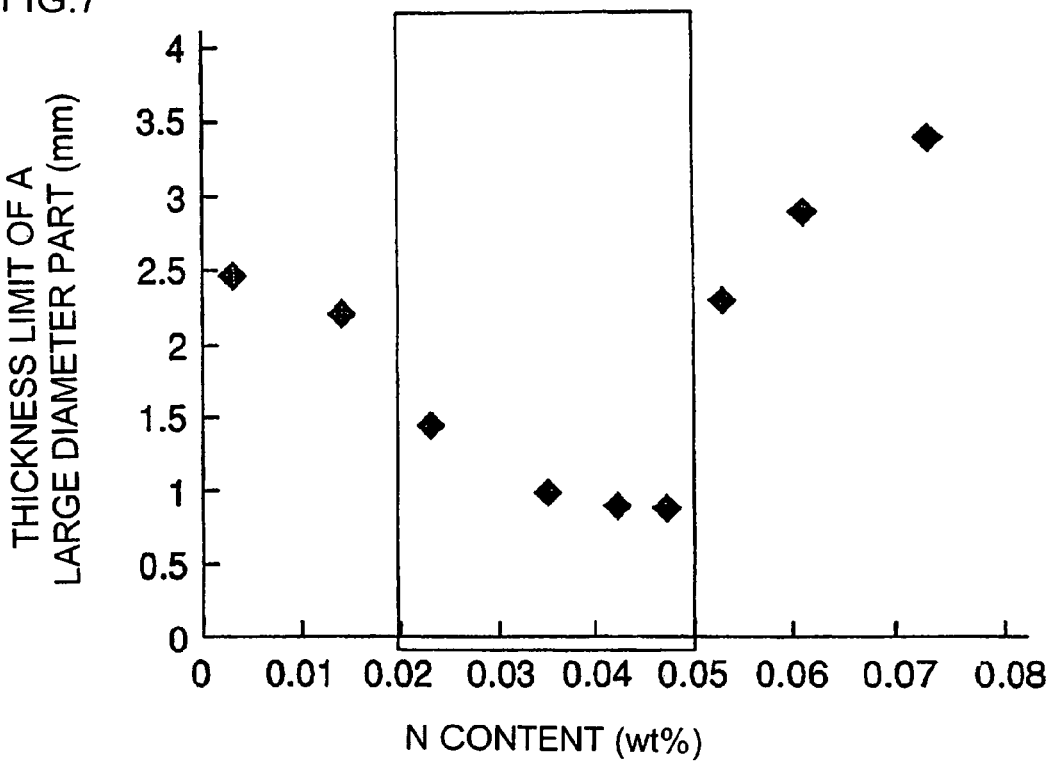
FIG. 7 is a diagram showing a relationship between a thickness limit of a large diameter part of the valve spring retainer and N content.

Further, using the testpieces Nos. 17 through 25, determination on whether or not cold forgeability was satisfactory was made on the basis of formability of the large diameter part 12*a* of the valve spring retainer 12, and results of the determination are shown in FIG. 7. That is, those within a range surrounded by a rectangle in FIG. 7 exhibited excellent cold forgeability when varying N content on conditions that 0.98 wt %≦Fe≦1.05 wt %, 0.269 wt %≦O≦0.3 wt %, and average grain size is in a range of 9 to 10 μm, showing that there is the need for 0.02 wt %≦N≦0.05 wt % to be able to form the large diameter part 12*a* of the valve spring retainer 12 to a thickness of 1.5 mm without causing cracks to occur thereto. In this connection, in determining whether or not cold forgeability is satisfactory, the thickness of 1.5 mm of the large diameter part 12*a* of the valve spring retainer 12 was adopted as the criterion for determination, and that is because the thickness of the large diameter part 12*a* of a conventional valve spring retainer has been 1.5 mm. Accordingly, if the large diameter part 12*a* can be formed to a thickness 1.5 mm, the peripheral components of the conventional valve spring retainer as they are can be applied to the valve spring retainer 12, as the peripheral components thereof, thereby making the most of a merit of lighter weight.

The testpieces Nos. 26 through 29 were used for determining whether or not cold forgeability was satisfactory by varying average grain size in a range of 19 to 97 μm in a state where Fe was fixed at 1.05 wt %, O at 0.277 wt %, and N at 0.023 wt %. Only the testpiece No. 29 of average grain size 19 μm was rated O in overall evaluation, indicating that there is the need for average grain size less than 20 μm in order to obtain stable cold forgeability. Further, with respect to the testpieces Nos. 1 through 25 as well, those rated O in cold forgeability do not include any with average grain size not less than 20 μm, indicating that it is possible to obtain more stable cold forgeability by keeping average grain size at less than 20 μm.

Incidentally, it is necessary apply surface treatment to the valve spring retainer 12 to provide the same with durability against abrasion due to sliding of the valve spring 14, and fretting with the split cotters 11, so that treatments, such as oxidation treatment, ion plating, plasma nitridation, plasma carburizing, and so forth, were studied, however, since the valve spring retainer 12 is made up of titanium, the treatments described cause deterioration in fatigue strength, and in many cases, it is necessary to prevent surface treatment from being applied to stress concentration parts, or to remove a surfacetreated layer formed in the stress concentration parts during after-processing, thereby creating a cause for increase in cost.

The inventor has newly found out that there is a correlation between 0 content in a matrix, and deterioration in fatigue strength, due to oxidation treatment applied to the surface thereof, and Table 2 shows results of tests for obtaining a fatigue strength ratio for fatigue strength before and after the oxidation treatment (fatigue strength after the oxidation treatment/fatigue strength before the oxidation treatment), by use of testpieces No. 1, 5, 6, 8, 11, 13, 30, and 31.

TABLE 2

| Testpiece | Composition | | | Tensile strength | Hardness | Fatigue strength |
|---|---|---|---|---|---|---|
| No. | Fe | O | N | MPa | HV0.1 | ratio |
| 1 | 1.03 | 0.200 | 0.027 | 690 | 223 | 0.51 |
| 5 | 0.90 | 0.243 | 0.033 | 720 | 238 | 0.55 |
| 6 | 1.13 | 0.255 | 0.023 | 733 | 243 | 0.55 |
| 8 | 0.96 | 0.268 | 0.027 | 733 | 244 | 0.55 |
| 11 | 1.07 | 0.300 | 0.031 | 771 | 253 | 0.57 |
| 13 | 0.83 | 0.318 | 0.035 | 779 | 258 | 0.57 |
| 30 | 0.05 | 0.120 | 0.010 | 490 | 172 | 0.46 |
| 31 | 0.97 | 0.165 | 0.027 | 660 | 210 | 0.45 |

In Table 2, the fatigue strength ratios indicate results of rotating bending fatigue tests conducted on testpieces with a U notch ($\alpha$=1.8), and oxidation treatment at 500° C. was applied to the testpieces for 5 hours.

Figure 8:
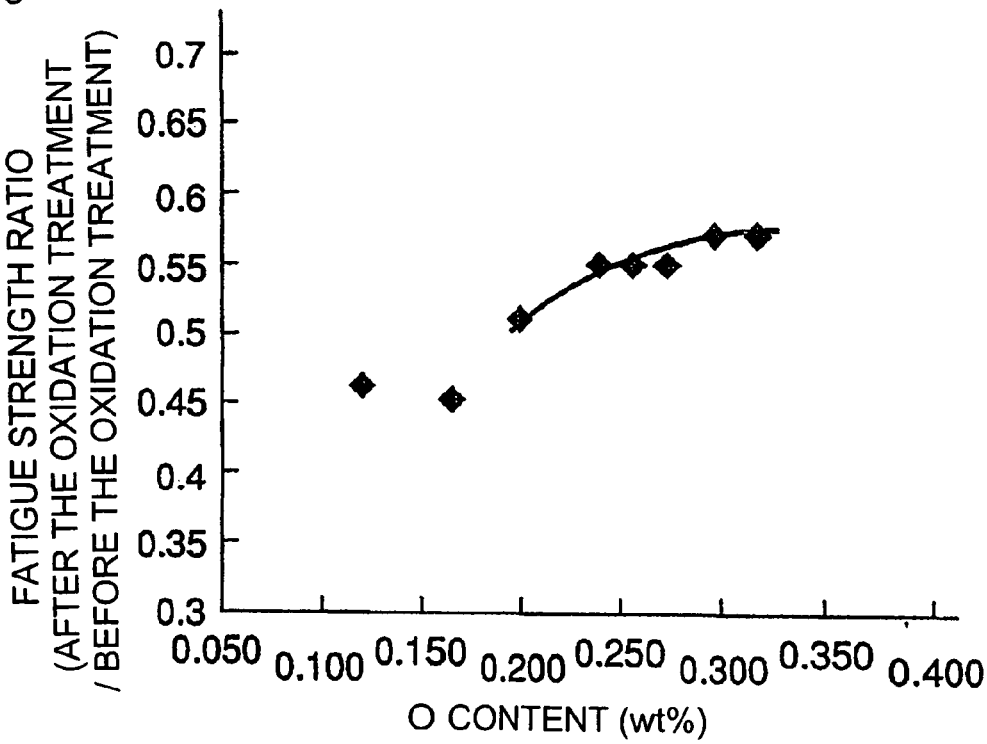
FIG. 8 is a graph showing a relationship between a fatigue strength ratio and O content.

A graph shown in FIG. 8 is obtained by plotting the fatigue strength ratios in Table 2, indicating that an advantageous effect of reducing deterioration in fatigue strength can be obtained if 0.20 wt %≦O. It was confirmed that the valve spring retainer 12 in a state where the oxidation treatment was applied to the entire surface thereof including the stress concentration parts could sufficiently secure the performance as the valve spring retainer 12, particularly, if 0.24 wt %≦O.

Figure 9:
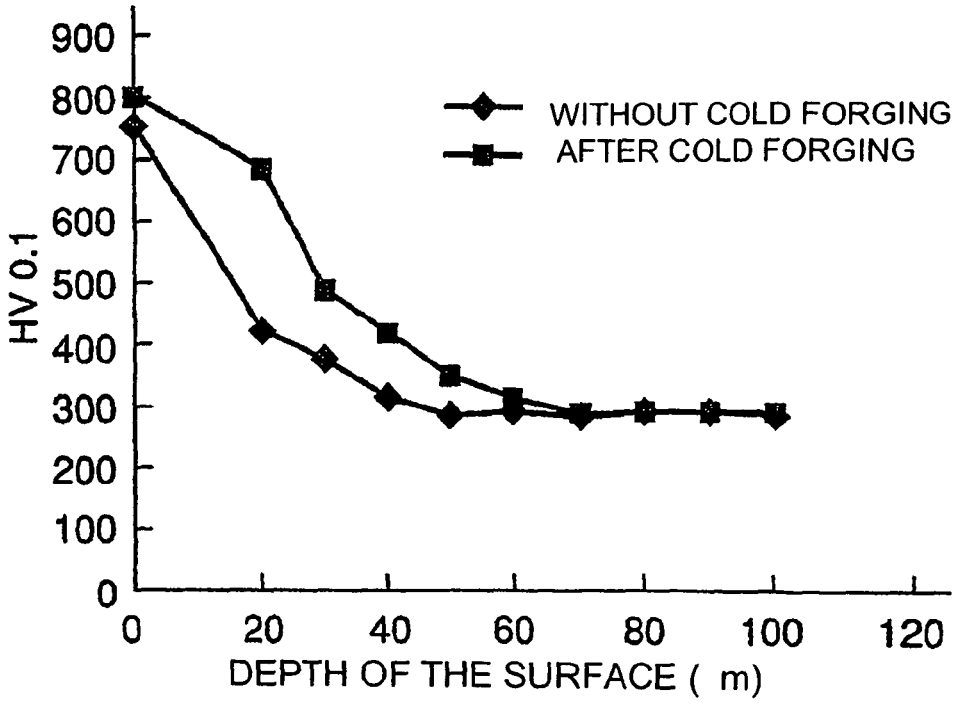
FIG. 9 is a graph showing a relationship between depth from the surface of a raw material and hardness.

As shown in FIG. 9, a relationship between depth from the surface and Vickers hardness was obtained by applying oxidation treatment at 750° C. for 3 hours to testpieces without cold forging applied, and testpieces after cold forging applied, and it is evident from the figure that if cold forging is applied before oxidation treatment, a penetration depth increases while oxygen diffusion time is shortened, and there is a large difference in hardness, particularly, directly underneath the surface (about 20 μm in depth), indicating a large advantageous effect of the cold forging before the oxidation treatment on enhancement in abrasion resistance.

Figure 10:
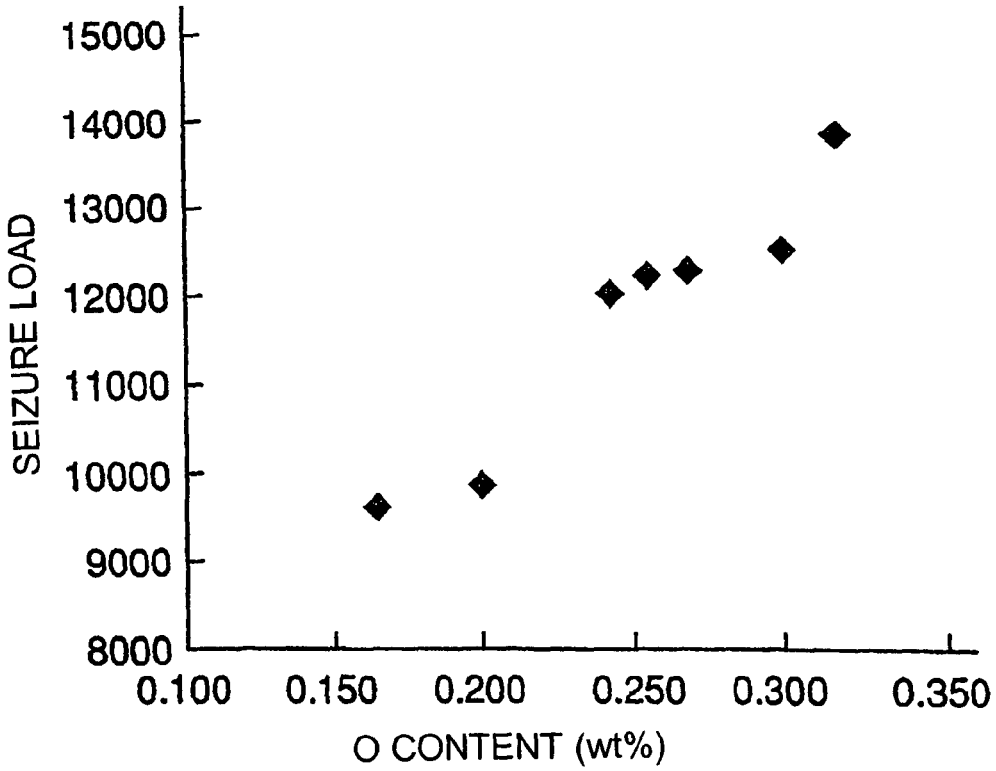
FIG. 10 is a graph showing a relationship between O content and seizure load.

Further, abrasion resistance is improved as O content increases, and Table 3 shows the results of examination of surface hardness and seizure load after oxidation treatment by use of the testpieces No. 1, 5, 6, 8, 11, 13, and 31. A graph shown in FIG. 10 is obtained by plotting the results in Table 3.

TABLE 3

| Testpiece | Composition | | | Tensile strength | Hardness | Surface hardness after oxidation treatment, | Seizure load |
|---|---|---|---|---|---|---|---|
| No. | Fe | O | N | MPa | HV0.1 | HV0.1 | N |
| 1 | 1.03 | 0.200 | 0.027 | 690 | 223 | 605 | 9850 |
| 5 | 0.90 | 0.243 | 0.033 | 720 | 238 | 616 | 12000 |
| 6 | 1.13 | 0.255 | 0.023 | 733 | 243 | 615 | 12200 |
| 8 | 0.96 | 0.268 | 0.027 | 733 | 244 | 616 | 12250 |
| 11 | 1.07 | 0.300 | 0.031 | 771 | 253 | 620 | 12500 |

TABLE 3-continued

| Testpiece | Composition | | | Tensile strength | Hardness | Surface hardness after oxidation treatment, | Seizure load |
|---|---|---|---|---|---|---|---|
| No. | Fe | O | N | MPa | HV0.1 | HV0.1 | N |
| 13 | 0.83 | 0.318 | 0.035 | 779 | 258 | 618 | 13800 |
| 31 | 0.97 | 0.165 | 0.027 | 660 | 210 | 598 | 9600 |

The results shown in Table 3, and FIG. 10 were obtained by tests with a Fabry tester, using SWOSC-V nitride material as a mating material, and an engine oil as a lubricant after oxidation treatment at 700° C. for 5 hours, and seizure occurred to a titanium material in a state where an oxidized layer thereof wore out, and the matrix thereof was exposed to the surface. It is evident from the results that it is possible to increase seizure load if 0.24 wt %≦O, thereby obtaining abrasion resistance sufficient for the valve spring retainer 12.

As described above, if a titanium alloy raw material composed of 0.8 wt %≦Fe≦1.2 wt %, 0.24 wt %≦O≦0.32 wt %, 0.02 wt %≦N≦0.05 wt %, and balance Ti containing unavoidable impurities is formed into the valve spring retainer 12 by cold forging, it becomes possible to reduce the cost of a raw material by use of inexpensive sponge titanium relatively high in impurity content, and further, to obtain high strength, and improve cold forgeability by optimally controlling respective addition amounts of Fe, O, and N as impurity elements, so that a manufacturing cost can be reduced by forming the valve spring retainer 12 through cold forging, and enhancement in yield can be aimed at while obtaining high productivity, thereby ensuring reduction in the manufacturing cost.

Further, if oxidation treatment is applied to the entire surface of the valve spring retainer 12 after cold forging, fatigue strength can be sufficiently secured owing to balance between O content of the raw material and surface oxidation, thereby more efficiently aiming at enhancement in fatigue strength, and improving abrasion resistance.

Further, since the raw material has tensile strength not less than 700 MPa, or cross section hardness not less than 230 HV0.1 in Vickers hardness, forming of the valve spring retainer 12 through cold forging is ensured, and reduction in the weight of the valve spring retainer 12 can be attained.

Still further, by setting the average grain size to less than 20 μm, it is possible to obtain stable cold forgeability while aiming at enhancement in fatigue strength.

Thus, by specifying alloy composition of the valve spring retainer 12 as above, in accordance with the teachings of the invention, highly productive cold forging is enabled while enhancing a raw material yield close to 100%, the cost of forming can be reduced to ⅕ of the conventional forming cost while reducing the cost of the raw material to about ½ to ⅓ of the cost of the conventional raw material, and further, the cost of surface treatment can be controlled to be equivalent to that of conventional heat treatment. As a result, the cost of the valve spring retainer 12 can be controlled to less than 1/10 of the convention titanium valve spring retainer made of titanium or within 2 to 3 times the cost of a steel valve spring retainer on a mass production basis, so that the valve spring retainer 12 can be satisfactorily put to use in the internal combustion engine of a mass-produced vehicle such as a low-fuel consumption vehicle, sport car, and so forth. In addition, the valve spring retainer 12 according to the invention is lighter in weight by 40% in comparison with the steel valve spring retainer on the mass production basis.

While the preferred form of the invention has been described as above, it is to be understood that the invention is not limited thereto, and various modifications in design may be made without departing from the spirit or scope of the appended claims.

For example, with the embodiment described as above, the valve spring retainer 12 of the exhaust valve 9 has been described, however, the invention can be applied to a valve spring retainer of an intake valve.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A cold forged titanium valve spring retainer, comprising:

0.8 wt %≦Fe≦1.2 wt %;

0.24 wt %≦O≦0.32 wt %;

0.02 wt %≦N≦0.05 wt %;

wherein the balance consists essentially of titanium, the valve spring retainer including a large diameter part, a small diameter part coaxially joined integral to a peripheral part of the large diameter part, a tapered part coaxially joined integral to a peripheral part of the small diameter part, the large diameter part having a diameter ranges from 1.5 cm to 2.5 cm, and an axial thickness that ranges from 1 mm to 2 mm, the small diameter part having an axial thickness that is greater than the axial thickness at the large diameter part, the tapered part having an axial thickness that is greater than the axial thickness at the large diameter part, wherein the valve spring retainer has a cross sectional hardness that is greater than or equal to 230 HV0.1 in Vickers hardness, and wherein prior to an oxidation treatment over an outer surface of the valve spring retainer the average grain size is less than or equal to 20 μm.

2. The valve spring retainer according to claim 1, further comprising oxidation treatment over an entire outer surface of the valve spring retainer, wherein a surface hardness of the valve spring retainer after the oxidation treatment is greater than or equal to 615 HV0.1 in Vickers hardness.

3. The valve spring retainer according to claim 1, wherein the valve spring retainer as a tensile strength that is greater than or equal to 700 MPa.

4. The valve spring retainer according to claim 2, wherein the valve spring retainer has a tensile strength that is greater than or equal to 700 MPa.

5. The valve spring retainer according to claim 1, further comprising:

an annular spring seat face having an outer edge that defines a periphery edge of the valve spring retainer; and a tapered hole position concentric with the annular spring seat face, the tapered hole being constructed to receive a end portion of a valve stem.

6. The method of manufacturing a valve spring retainer, comprising:

cold forging a titanium alloy into the valve spring retainer, the alloy comprising:

0.8 wt %≦Fe≦1.2 wt %;

0.24 wt %≦O≦0.32 wt %;

0.02 wt %≦N≦0.05 wt %;

wherein the balance consists essentially of titanium;

the valve spring retainer including:

a large diameter part, a small diameter part coaxially joined integral to a peripheral part of the large diameter part, a tapered part coaxially joined integral to a peripheral part of the small diameter part, wherein the large diameter part having a diameter ranges from 1.5 cm to 2.5 cm, and an axial thickness that ranges from 1 mm to 2 mm, the small diameter part having an axial thickness that is greater than the axial thickness at the large diameter part, the tapered part having an axial thickness that is greater than the axial thickness at the large diameter part, wherein the valve spring retainer has a cross sectional hardness that is greater than or equal to 230 HV0.1 in Vickers hardness, and wherein prior to an oxidation treatment over an outer surface of the valve spring retainer the average grain size is less than or equal to 20 μm.

7. The method according to claim 6, further comprising oxidizing the entire outer surface of the valve spring.

8. The method according to claim 6, further comprising:

cutting a wire rod from a wire;

swaging the wire rod to form a disk shaped blank;

punching a center hole in the disk shaped blank; and forging the disked shaped blank having the center hole therein into a valve spring retainer.

9. The valve spring retainer according to claim 6, wherein the step of forging the titanium alloy into its final shape comprises:

forming an annular spring seat face having an outer edge that defines a periphery edge of the valve spring retainer; and forming a tapered hole position concentric with the annular spring seat face, the tapered hole being constructed to receive an end portion of a valve stem.

* * * * *